United States Patent [19]

Schloemann

[11] Patent Number: 4,651,116

[45] Date of Patent: Mar. 17, 1987

[54] VIBRATION INSENSITIVE MAGNETICALLY TUNED RESONANT CIRCUIT

[75] Inventor: Ernst F. R. A. Schloemann, Weston, Mass.

[73] Assignee: Raytheon Company, Lexington, Mass.

[21] Appl. No.: 835,444

[22] Filed: Feb. 27, 1986

Related U.S. Application Data

[63] Continuation of Ser. No. 599,030, Apr. 11, 1984, abandoned.

[51] Int. Cl.[4] ..... H01P 7/00

[52] U.S. Cl. ..... 333/235; 333/202; 333/24.1; 333/215

[58] Field of Search ..... 333/202, 206, 207, 209, 333/219, 222, 223, 227, 231, 235; 335/215

[56] References Cited

U.S. PATENT DOCUMENTS

| | | | |
|---|---|---|---|
| 3,576,503 | 4/1971 | Hanson | 333/235 X |
| 4,334,201 | 6/1982 | Shores | 333/202 |
| 4,484,161 | 11/1984 | Barger | 333/202 |
| 4,506,240 | 3/1985 | Shores | 333/202 |

*Primary Examiner*—Paul Gensler

*Attorney, Agent, or Firm*—Denis G. Maloney; Richard M. Sharkansky

[57] ABSTRACT

A magnetically tuned resonant circuit having a resonant frequency which is substantially invariant with external applied static and dynamic stresses is provided. The magnetically tuned resonant circuit includes a housing which provides a magnetic flux return loop. A central post of the magnetically tuned resonant circuit includes a pair of pole pieces, upper and lower portions of the housing, a magnet and an RF structure. The RF structure including a pair of coupling loops and a YIG sphere disposed between the coupling loops is disposed between the pair of pole pieces. In a first embodiment, the elastic compliance of the center post portion of the magnetically tuned resonant circuit is increased by a predetermined amount by providing a nonmagnetic collar around a first one of the pole pieces disposed between said pole piece and the RF structure. In an alternate embodiment, a relatively high compliant RF structure is provided by providing a raised peripheral edge portion on a first surface of the RF structure and a raised central inner portion on a second, opposite surface of the RF structure. With this arrangement, the RF structure is permitted to flex and bend in accordance with applied external forces thereby providing a relatively high compliant structure. In accordance with a further embodiment of the invention, the material of the magnetically tuned resonant circuit is selected to have a saturation magnetostriction constant of less than or equal to $3.2\times10^{-6}$. In accordance with a further embodiment of the invention, the housing of the magnetically tuned resonant circuit is provided such that the product of the compliance of the upper portion of the housing and the mass associated with the upper portion of the housing is substantially equal to the product of the compliance of the bottom portion of the housing and the mass associated with the bottom portion of the housing.

25 Claims, 7 Drawing Figures

VIBRATION INSENSITIVE MAGNETICALLY TUNED RESONANT CIRCUIT

This application is a continuation of application Ser. No. 599,030 filed Apr. 11, 1984 (now abandoned).

BACKGROUND OF THE INVENTION

This invention relates generally to radio frequency circuits and more particularly to tuned radio frequency resonant circuits.

As is known in the art, radio frequency resonant circuits, such as a magnetically-tuned resonant circuit, are often used in radio frequency receivers. The magnetically-tuned resonant circuit generally includes a body of a ferrimagnetic material which in the presence of an external magnetic field provides the resonant circuit. A sphere comprising yttrium iron garnet (YIG) is often employed as the ferrimagnetic body. Generally in a so-called YIG filter, for example, two coupling loops, a first coupling loop disposed about an X-axis and a second coupling loop disposed about a Y-axis are provided with the YIG sphere being disposed within both loops. Each coupling loop is a conductor, shaped as a semicircle, with each coupling loop being disposed around a different portion of the YIG sphere. Generally, the coupling loops and the sphere are disposed in a body member commonly referred to as an RF structure. With a single crystal YIG sphere disposed in the RF structure and in the presence of suitably applied DC or steady magnetic field intensity $H_{dc}$, such as applied between a pair of magnetically coupled pole pieces, the YIG body responds to an applied input RF signal fed to one of said coupling loops, if the input signal has a frequency component substantially equal to the resonant frequency $f_o$ of the resonant circuit provided by the YIG sphere and magnetic field passing through the sphere. The resonant frequency $f_o$ of such a sphere in a uniform resonant mode is given as $f_o=\gamma H_{dc}$ where $f_o$ is the centerband resonant frequency in the uniform resonant mode, $\gamma$ is a quantity which is a function of the material and which is generally referred to as the gyromagnetic ratio, and $H_{dc}$ is the magnitude of the applied DC magnetic field. Therefore, a portion of an RF input signal, fed to the input one of the afore-mentioned coupling loops, for example, the X axis coupling loop, is coupled through the YIG body to the output one of the coupling loops here the Y axis coupling loop if the portion of the input signal has a frequency component which equals the resonant frequency of the YIG circuit given by the relation $f_o=\gamma H_{dc}$.

One problem associated with magnetically-tuned resonant circuits, such as the one described above, is the phenomenon generally referred to as microphonics. Microphonics is here a term which refers to the noise produced in an output signal in response to an externally applied mechanical force such as encountered during vibration of the YIG filter. The presence of a YIG filter in a vibrating environment provides external forces onto the YIG filter housing which provides small dynamic mechanical distortions in the filter housing, and concomitant therewith, changes in the magnetic permeability of the magnetically permeable portion of the YIG filter and hence the magnetic field strength $H_{dc}$. Since the resonant frequency is a function of the field strength, the resonant frequency will also change in response to the external forces applied to the filter housing. In certain applications of a YIG filter, the resonant frequency of the filter must be maintained substantially at the desired resonant frequency independent of any mechanical vibration to which the YIG filter may be exposed. In some applications, this requirement is difficult to satisfy, particularly when the YIG filter is disposed in a vibrating environment such as is found, for example, in a guided missile.

SUMMARY OF THE INVENTION

In accordance with the present invention, a magnetically-tuned resonant circuit having a resonant frequency which is substantially invariant with externally applied static and dynamic mechanical stresses is provided. The magnetically-tuned resonant circuit includes a housing which provides a magnetic flux return path. A central post of the magnetically tuned resonant circuit includes: a pair of pole pieces, upper and lower portions of the housing, a magnet, and an RF structure. The RF structure is disposed between the pair of pole pieces and includes a pair of coupling loops and a YIG sphere disposed between the coupling loops. In a first embodiment, a nonmagnetic collar is provided around a portion of a first one of the pole pieces and between such pole piece and the RF structure. The collar has a height selected to provide a predetermined spacing between a surface portion of such pole piece and a surface portion of the RF structure. With such an arrangement, the collar provided around the pole piece substantially reduces the elastic stress in the pole piece resulting from external forces applied to the resonant circuit and concomitant therewith also reduces the negative shift in resonant frequency generally associated with mechanical stresses provided to the pole piece. Further, the collar provided around the first one of the pole pieces increases the compliance of the remaining portions of the center post, and thus reduces the elastic stress in those parts of the center post that are not surrounded by the collar and the negative shift in resonant frequency concomitant therewith. Further still, by providing the space between the facial portion of the first pole piece and the surface portion of the RF structure, a magnetic gap is provided which results in a positive resonant frequency shift as said magnetic gap is closed in response to the applied external forces. Therefore, the positive shift in resonant frequency associated with closing the magnetic gap in combination with the aforementioned reductions in the negative shift in resonant frequency provides a net substantially reduced shift in resonant frequency in response to changes in externally applied mechanical stress.

In accordance with an additional aspect of the present invention, an RF structure is provided between the pole pieces by arranging the RF structure to be in mechanical contact with the outer peripheral portion of a first one of the pair of pole pieces and an inner central portion of a second one of the pole pieces. With such an arrangement, a relatively compliant, flexible RF structure is provided. That is, the RF structure is able to flex and bend in response to externally applied mechanical stresses, increasing the elastic compliance of the center post and thus reduces the changes in the magnetic permeability of the center post due to the mechanical stresses and hence reduces the shifts in resonant frequency concomitant therewith.

In accordance with an additional aspect of the present invention, the magnetic housing of the filter is arranged such that the product of the mechanical compliance of the top portion of the housing and the effective mass associated with the top portion of the housing is substantially equal to the product of the mechanical compliance of the bottom portion of the housing and the effective mass associated with the bottom portion of the housing. With such an arrangement, a substantially mechanically symmetric filter housing is provided wherein stresses applied to the outer portion of the housing will provide relatively small net stresses in the center post, and hence will provide relatively small changes in the magnetic field, and concomitant therewith, relatively small shifts in resonant frequency.

In accordance with a further aspect of the present invention, the material of the outer housing of the magnetically-tuned resonant circuit is selected to have a relatively small saturation magnetostriction characteristic. With such an arrangement, selecting the material of the housing to have a relatively low saturation magnetostriction characteristic reduces the changes in the magnetic permeability of the housing which are caused by the mechanical deformation of the filter housing, thereby reducing the changes in resonant frequency generally associated therewith.

BRIEF DESCRIPTION OF THE DRAWINGS

The foregoing features of the present invention, as well as the invention itself, may be more fully understood from the following detailed description taken in conjunction with the accompanying drawings, in which.

DESCRIPTION OF THE PREFERRED EMBODIMENTS

Figure 1:
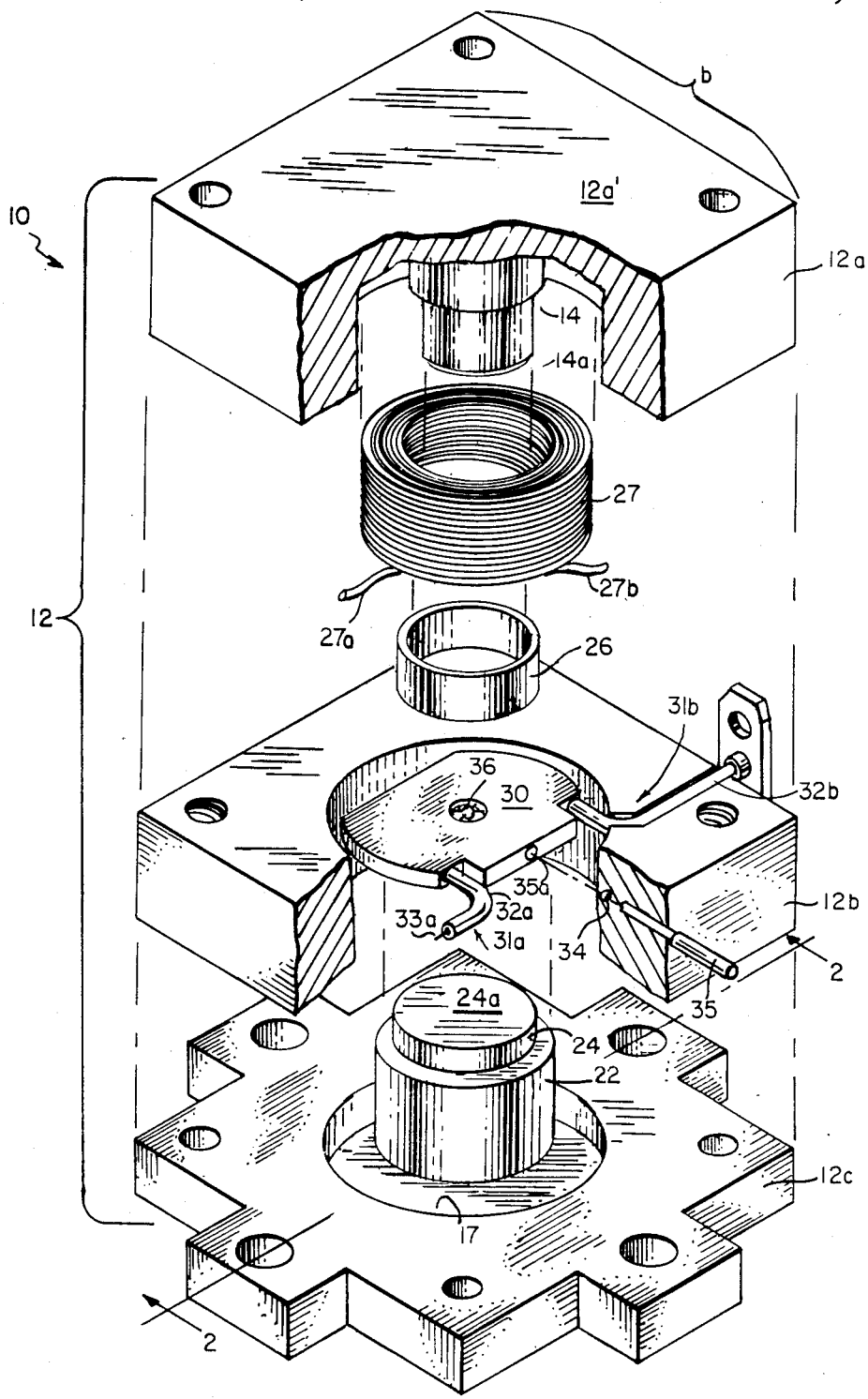
FIG. 1 is a composite, diagrammatical, isometric view, partially broken away of a magnetically-tuned resonant circuit having a load bearing cylindrical member in accordance with one aspect of the present invention.
Figure 2:
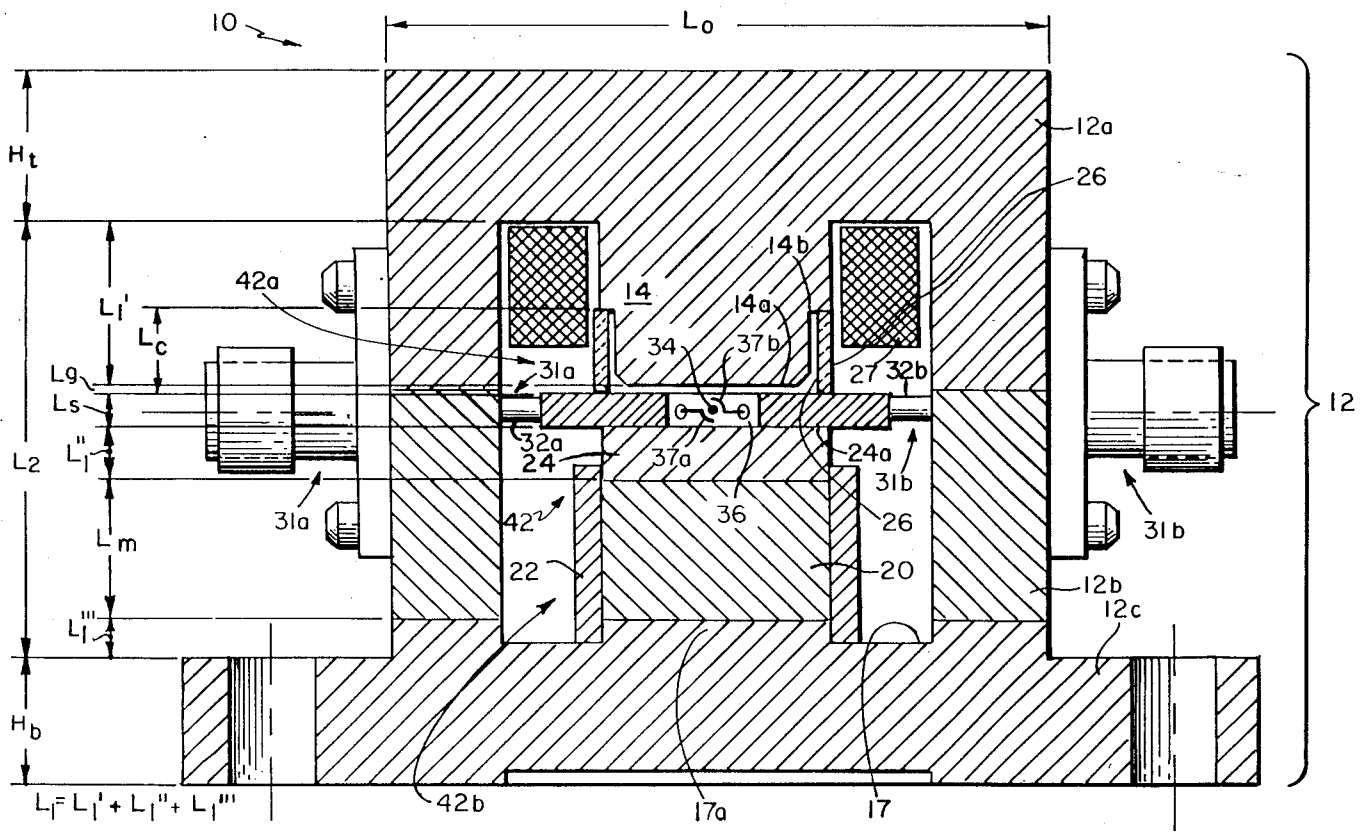
FIG. 2 is a cross-sectional view taken along lines 2—2 of the magnetically-tuned resonant circuit of FIG. 1.
Figure 3:
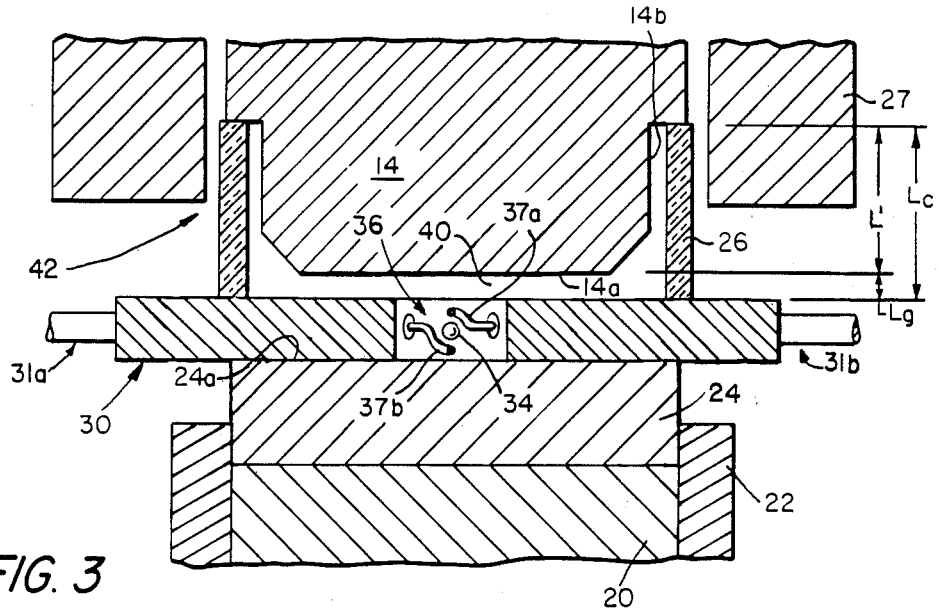
FIG. 3 is a cross-sectional enlarged view of a portion of the resonant circuit shown in FIG. 2 detailing the position and location of the cylindrical member.

Referring now to FIGS. 1–3, a magnetically-tuned resonant circuit 10, here a YIG filter is shown to include a composite filter housing 12 having an upper shell section 12*a*, an intermediate shell section 12*b* and a lower shell section 12*c* connected together, as shown in FIG. 2. Composite filter housing 12 comprises a magnetic permeable material and provides a closed magnetic path or flux return path to direct magnetic flux through a gyromagnetic member 34 in a manner to be described. Upper shell section 12*a* includes an inner centrally disposed fixed pole piece 14, said fixed pole piece portion 14 having an exposed surface portion 14*a*. Lower shell section 12*c* includes an integral inner centrally disposed portion 17, upon which is disposed a permanent magnet 20, and a second here removable pole piece 24 having an exposed surface portion 24*a*. A temperature-compensating sleeve 22 is disposed around removable pole piece 24 and magnet 20. Intermediate shell portion 12*b* is shown having disposed over an upper surface portion thereof an RF structure 30. The RF structure 30 is disposed between the surface portion 14*a* of fixed pole piece 14 and surface portion 24*a* of pole piece 24. The RF structure 30, here being comprised of a magnetically inert material as is well known in the art, has a cavity portion 36 and includes a pair of coaxial transmission lines 31*a* and 31*b*. Each one of such coaxial transmission lines 31*a*, 31*b* includes an outer conductor 32*a*, 32*b* (FIGS. 1, 2) dielectrically spaced from an inner conductor 33*a*, shown for coaxial transmission line 31*a* and an inner conductor (not shown) for coaxial transmission line 31*b*. The RF structure 30 further includes here a spherical body 34 comprising a gyromagnetic material such as yttrium iron garnet (YIG). YIG sphere 34 is disposed on an end portion of a mounting rod 35, said mounting rod 35 and YIG sphere 34 being disposed through a passageway 35*a* provided in the RF structure 30, such that YIG sphere 34 is disposed within the cavity 36, as shown in FIG. 2. The RF structure 30 further includes a pair of coupling loop portions 37*a* and 37*b* of center conductors 33*a*, 33*b*, respectively, said loop portions 37*a*, 37*b* being disposed in cavity 36 and around portions of the YIG sphere 34, with portions of said YIG sphere 34 being disposed within each one of said coupling loops 37*a*, 37*b*. The first one of such coupling loops, here 37*a* is disposed about an X axis and a second one of said coupling loops 37*b* is disposed about a Y axis. Each one of said coupling loop portions 37*a*, 37*b* of center conductors 33*a*, 33*b* has an end thereof end coupled to the RF structure. Therefore, the first one of said coaxial conductors 31*a*, 31*b* is used to feed input radio frequency energy to the RF structure, and a second one of such coaxial conductors 31*a*, 31*b* in the presence of an applied external magnetic field $H_{dc}$ is used to couple a selected portion of said input radio frequency energy fed to the first one of such coaxial conductors 31*a*, 31*b* to the second one of such coaxial conductors 31*a*, 31*b*. This coupled radio frequency energy has a band of frequencies in accordance with the equation $f_o=\gamma H_{dc}$, where $f_o$ is the resonant frequency of the filter 10, where $\gamma$ is a quantity referred to as the gyromagnetic ratio and is approximately equal to 2.8 MHz/Oersted for YIG, and $H_{dc}$ is the magnetic field strength provided in the vicinity of the YIG sphere from the permanent magnet 20 between the facial portions 14*a*, 24*a* of pole pieces 14 and 24. A center or central post portion 42 of the YIG filter 10 is defined to include the pole pieces 14 and 24, magnet 20, gap 40 and RF structure 30.

The YIG filter 10 is shown to further include a coil 27, having terminals 27*a*, 27*b* for coupling to a current source (not shown), disposed around the pole piece portion 14 of upper housing shell section 12, said coil being used to provide a selectable amount of magnetic field variation in said RF filter to tune said RF filter to a predetermined resonant frequency.

Figure 4:
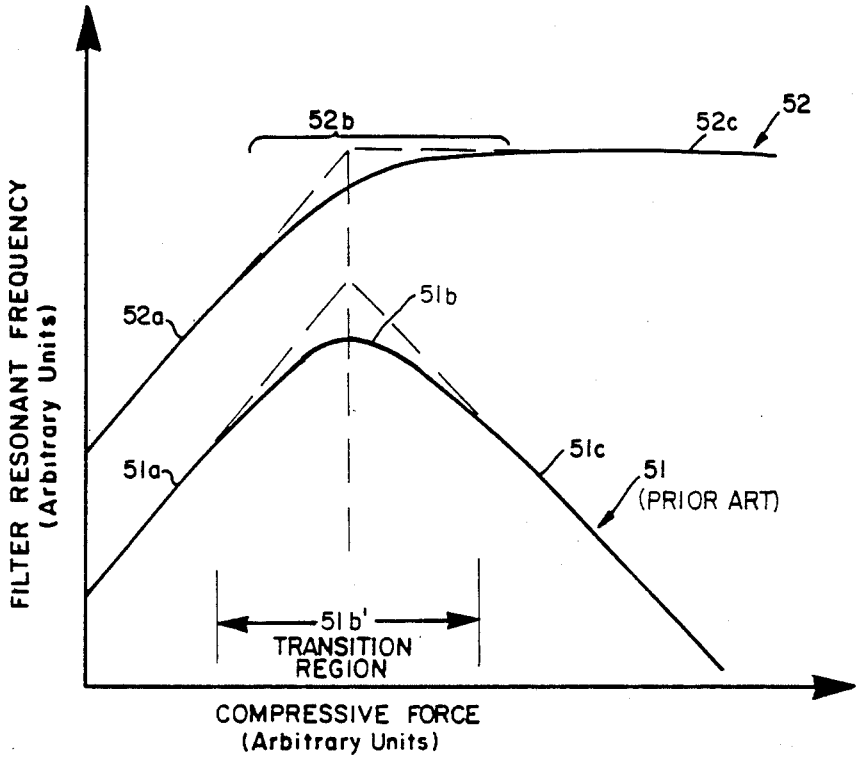
FIG. 4 is a graph of resonant frequency versus compressive force in arbitrarily selected units showing a qualitative relationship between resonant frequency and applied force for a typical prior art magnetically-tuned resonant circuit, and a typical magnetically-tuned resonant circuit fabricated in accordance with the present invention.

Referring now to FIG. 4, there is shown a typical representation of resonant frequency (Y axis) as a function of an externally applied mechanical compressive force (X axis) for a typical magnetically-tuned resonant circuit of the prior art, curve 51, and for a typical magnetically-tuned resonant circuit constructed in accordance with the present invention, curve 52. Curve 51 representative of the prior art can be characterized as including a substantially straight ascending branch 51*a*, a substantially straight descending end branch 51*c*, and an intermediate curved portion 51*b* providing a transition region 51*b*'. A resonant frequency dependence as a function of an externally applied mechanical compressive force of this type is observed only when the filter housing has a small magnetic gap provided between the fixed pole piece and the RF structure prior to application of the external stress. The ascending branch generally arises from the deformation of the filter housing caused by the compressive force which gradually closes the air gap as the force is increased. After the gap has been closed, the resonant frequency drops with increasing load. It is believed that the drop in resonant frequency as a function of increasing load occurs due to the fact that the permeability of the housing material, particularly the material of the upper pole piece 14 and the lower pole piece 24 disposed on the magnet 20 decreases with increasing compressive stress.

On the other hand, curve 52 can be characterized as including a substantially-straight ascending branch 52*a*, a substantially horizontal end branch 52*c* and an intermediate curved transition region 52*b*. A frequency dependence of this type is observed when the filter is constructed in accordance with the principals of the present invention, as will be described, and has an initial air gap. The ascending branch 52*a* is substantially unchanged from the prior art structure since as the provided gap is closed by the applied stress, the resonant frequency increases as before. The descending characteristic of the end branch 52*c* is substantially eliminated and for a stress greater than that required to close the initial gap 40, a substantially constant relationship is provided between applied stress and resonant frequency. Therefore, there is a broader range of compressive forces over which the resonant frequency is substantially independent of external compressive force.

A first technique to reduce the sensitivity of the magnetic field and hence the resonant frequency of the YIG filter as a function of externally applied mechanical force may be understood by considering the following analysis:

I have determined that magnetostriction of the material of the filter housing 12 is an important source of changes in resonant frequency of the magnetically tuned resonant circuit as a function of applied external force.

The variation in permeability $\mu$ of a material as a function of compressive stress ($\sigma$) for materials with positive saturation magnetostriction $\lambda_s$ has been theoretically determined as described in E. Kneller, "Ferromagnetisms," Springer (Heidelberg, Berlin, Germany) 1962, pp. 543–550 to be:

$$\mu = 1 + \frac{4\pi(M_s)^2}{3\lambda_s\sigma} \tag{1}$$

where $M_s$ is the saturation magnetization and where $\lambda_s$ is the saturation magnetostriction of the housing material. As is known in the art, magnetized materials undergo an elastic deformation when magnetized. Saturation magnetostriction is the magnetostriction of the material under saturation magnetization. $\lambda_s$ can be expressed in terms of the single crystal magnetostrictive constants $\lambda_{100}$ and $\lambda_{111}$ as:

$$\lambda_s = (2\lambda_{100} + 3\lambda_{111})/5 \tag{2}$$

Equation (1) is based on the assumption that magnetization proceeds through domain rotation in the presence of a stress induced magnetic anisotropy. A similar formula which differs from (1) only by a constant factor applies also when magnetization proceeds through domain wall motion, rather than domain rotation. Equation (1) has been extensively tested on nickel (which has $\lambda_s < 0$) under tension ($\sigma < 0$), and has been found to agree well with the experimental data. It should be understood, however, that the simple formula (1) is not expected to apply in the limit $\sigma \rightarrow 0$, since $\mu$ would become infinite. In this limit, the permeability is determined by other processes that are beyond the scope of the present discussion.

Where the elastic stress $\sigma$ is of intermediate magnitude and thus $\mu >> 1$, Equation (1) can be simplified as:

$$\frac{1}{\mu} = \frac{3\lambda_s\sigma}{4\pi(M_s)^2} \tag{3}$$

$$\text{or } \sigma\mu = \frac{4\pi(M_s)^2}{3\lambda_s} \tag{4}$$

The theoretical factor $$\frac{4\pi(M_s)^2}{3\lambda_s}$$

described above may be numerically evaluated for a housing in which the material of the high permeability portion thereof comprises a nickel-iron alloy known as "4750," which has a relatively high magnetostrictive constant $\lambda_s$. For the alloy "4750" the relevant material parameters are:

$$4\pi M_s = 15{,}400 \text{ Gauss}$$

$$\lambda_2 = 21.7 \times 10^{-6} \tag{5}$$

and hence, $$\frac{4\pi(M_s)^2}{3\lambda_s} = 2.9 \times 10^{11} \frac{\text{dyn}}{\text{cm}^2} = 4.2 \times 10^6 \text{ psi} \tag{6}$$

This factor $4\pi(M_s)^2/3\lambda_s$ and hence the sensitivity of resonant frequency to changes in stress can be significantly reduced by using a housing material with a smaller magnetostrictive constant $\lambda_s$ than "4750." Such a material is the Carpenter HyMu "80" material obtainable from Carpenter Steel, Reading, Pa. Currently there is no data concerning the magnetostrictive constants of this material. On the basis of literature values for $\lambda_{100}$ and $\lambda_{111}$ for similar NiFe materials and equation 2, however, in NiFe alloys, one may estimate a value for $\lambda_s$ of $+3.2 \times 10^{-6}$, but this estimate neglects the rather substantial Molybdenum content of HyMu "80" which would tend to further reduce $\lambda_s$. Using $\lambda_2=3.2\times10^{-6}$ and $4\pi M_s=8000$ Gauss, one obtains:

$$\frac{4\pi M_s^2}{3\lambda_s} = 5.31 \times 10^{11} \frac{\text{dyn}}{\text{cm}^2} = 7.7 \times 10^6 \text{ psi} \quad (7)$$

Comparing the evaluation of Equation (4) for the alloy "4750" and the alloy HyMu "80", the factor $4\pi M_s^2\lambda_s$ is approximately 1.8 times larger for "HyMu 80" than 4750. This implies that the load sensitivity would be correspondingly smaller for the HyMu 80 material. If $\lambda_s$ is actually smaller than $3.2\times10^{-6}$ (which appears likely), the load sensitivity would be reduced by a proportionately larger factor.

A second technique for reducing the change in resonant frequency as a function of externally applied stress includes providing a stress compensating or load bearing member, here a nonmagnetic hollow, cylindrical member 26 around a portion 14*b* having a length L' of the fixed pole piece portion 14 of upper shell section 12. As shown more clearly in FIG. 3, the cylindrical member 26 has a predetermined length $L_c$ which is selected to protrude beyond the surface 14*a* of pole piece 14 a predetermined amount $L_g$. Thus, the length $L_c$ of cylindrical member 26 is selected to be larger than the length L' of portion 14*b* of the pole piece. This incremental difference $L_g=L'-L_c$ provides a predetermined space or gap 40 of the predetermined length $L_g$ between the RF structure 30 and the exposed facial portion 14*a* of fixed pole piece 14. The cylindrical member 26 and gap 40 are provided to compensate for shifts in resonant frequency caused by static or dynamic mechanical loading of the YIG filter 10 in a manner to be described.

The cylindrical member 26 is preferably comprised of a nonmagnetic and nonconductive material. The material of the cylindrical member 26 is chosen to be nonconductive because a conductive material would provide a closed path for induced eddy current flow in response to the changing RF magnetic field associated with coupling of resonant frequency energy through the magnetically-tuned circuit 10. Therefore, in order to substantially eliminate such eddy currents and the losses associated therewith, the material of the annular member is chosen to be nonconductive. A material such as alumina may be used. However, the nonconductive cylindrical member 26 may be replaced by any nonmagnetic spacer member not having such a closed path. Alternative examples of such members include a cylindrical member having a slit through said annular member provided to interrupt the path or a plurality of spaced members disposed between the RF structure 30 and the pole piece 14.

As previously mentioned, the center or central post composite member 42 includes the fixed pole piece 14, RF structure 30, gap 40, lower pole piece 24 and magnet 20. The annular member 26 reduces changes in resonant frequency as a function of externally applied mechanical forces in the following ways: Firstly, it substantially reduces elastic stress from the portion of the center post 42 (i.e., the pole piece 14) that is surrounded by the cylindrical member 26, thereby reducing magnetostrictive effects on the permeability of the material of fixed pole piece portion 14 of the center post 42 and the negative shift in resonant frequency associated therewith. Secondly, it makes the center post 42 as a whole substantially more compliant thereby reducing the elastic stress in those parts of the center post 42 that are not surrounded by the cylindrical member 26 and hence reduces the magnetostrictive effects on the permeability of the material of the remaining portion of the center post 42 and the negative shift in resonant frequency associated therewith. Thirdly, by selecting the cylindrical member 26 to protrude a predetermined amount, the member 26 provides a magnetic gap (length$=L_g$) between the upper fixed pole piece 14 and the RF structure 30. As the compressive stress is increased, the size of the magnetic gap is reduced and a small positive frequency shift due to a decreasing gap length is provided which acts to partially compensate for the remaining portions of the negative shift in resonant frequency caused by the magnetostrictive effects described above. Therefore, by proper selection of pole piece height and collar length, a proper size gap is provided between the pole piece and the RF structure which will provide the requisite positive shift in resonant frequency compensate for the residual negative shifts in resonant frequency associated with the elastic stresses provided to the center post. Thus, the resonant frequency is substantially invariant with changes in compressive force over a relatively wide range of changes in compressive force.

The following analysis may be useful in understanding how the cylindrical member 26 reduces the net changes in resonant frequency as a function of compressive force.

The load sensitivity, for a centrally applied force (CAF) where the force (F) is larger than the force ($F_c$) required to close an initial gap ($F>F_c$), is reduced by providing the load-carrying, nonmagnetic cylindrical member 26 such as shown in FIGS. 1–3. The cylindrical member 26 surrounds the pole piece 14*b* and protrudes beyond the flat surface 14*a* of piece 14 by a small amount $L_g$ (e.g., 0005" to 0.001"). As shown in FIG. 3, the pole piece portion 14*b* includes straight side wall portions instead of the usual tapered side wall portions. This assures that a downward force can be transmitted from the top part of the filter housing 12*a* to the bottom 12*c* without exerting a bending moment on the RF structure 30. Alternatively, the entire pole piece 14 could be surrounded by a second cylindrical member (not shown) with a height slightly exceeding that of the pole piece.

A filter housing of the type shown in FIG. 1 may be characterized by the following geometrical parameters, as depicted in FIG. 2, (all lengths are in inches and areas are in square inches).

| | | | |
|---|---|---|---|
| $L_o = 1.2$ | | $H_t = .350$ | (8a) |
| $L_1 = .485$ | $H_b = .260$ | | |
| $L_2 = .880$ | $b = 1.2$ (FIG. 1) | | |
| $L_m = .315$ | $A_1 = .166$ | | |
| $L_s = .080$ | $A_2 = 1.324$ | | |

Here $L_1$ is the combined length of all parts of the central post that comprise the high permeability housing material, i.e., the upper pole 14, pole piece 24 and magnet base 17*a* as given in Equation 8*b*.

$$L_1=L_1'+L_1''+L_1''' \quad (8b)$$

where $L_1'$, $L_1''$ and $L_1'''$ are the lengths as indicated in FIG. 2, and $A_1$ and $A_2$ are the areas of the center post portion 42 equal to the surface area of the surface 24a and a surface portion 12a' of upper shell section 12a, respectively. The compliances of the various housing portions excluding the effects of the cylindrical member 26 are for:

outer housing:

$$c_2 = L_2/A_2E \tag{9a}$$

where E is the elastic moduli of the outer housing, central post (provided there is no air gap):

$$c_1 = \frac{L_1}{A_1E} + \frac{L_s}{A_1E_s} + \frac{L_m}{A_1E_m} \tag{9b}$$

and where $E_s$ and $E_m$ are the elastic moduli of the RF structure 30 and magnet 20, respectively: top plate $$c_t = \frac{1}{4Eb}\left(\frac{L_o}{H_t}\right)^3 \tag{9c}$$

bottom plate $$c_b = \frac{1}{4Eb}\left(\frac{L_o}{H_b}\right)^3 \tag{9d}$$

where E is the elastic modulus of the housing, b (FIG. 1) is the depth of the housing, and $H_t$ and $H_b$ are as given in FIG. 2. The compliances calculated according to Equations 9a–9d are:

$$\begin{aligned} c_1 &= 236 \times 10^{-9} \text{ inch/pound} \\ c_2 &= 30 \times 10^{-9} \text{ inch/pound} \\ c_t &= 373 \times 10^{-9} \text{ inch/pound} \\ c_b &= 910 \times 10^{-9} \text{ inch/pound} \end{aligned} \tag{10}$$

A theoretical estimate of the load sensitivity of a YIG filter of the type shown in FIG. 1 having the load-carrying cylindrical member 26 may be obtained by assuming that the compressive stress is zero in the reduced diameter pole portion 14 that protrudes into the cylindrical member 26 and that it is uniformly distributed outside. If $L_c$, $A_c$ and $E_c$ are the length, cross-sectional area, and Young's modulus of the member 26 and $L_1$, the total length of the high permeability portion of the center post 42, $A_1$ the cross-sectional area of the central post and E, $E_s$ and $E_m$, the Young modulus of filter housing 12, the RF structure 30 and the magnet 20 as before, the compliance $c_1$ of the center post 42 is given by the sum of the compliance of the individual members as:

$$c_1 = \frac{(L_1 - L_c)}{A_1E} + \frac{L_c}{A_cE_c} + \frac{L_s}{A_1E_s} + \frac{L_m}{A_1E_m} \tag{11}$$

and the load sensitivity (i.e., change in frequency as a function of a change in force) for a centrally applied force (CAF) sufficient to close an initial magnetic gap ($F > F_c$) is given as:

$$\frac{df_o}{dF} = - \tag{12}$$

-continued $$\frac{f_oA_1}{L_m(c_1 + c_2 + c_t + c_f)}\left\{\frac{3\lambda_s}{4\pi(M_s)^2}\left[\frac{(L_1 - L_c)(c_t + c_2)}{A_1^2} + \frac{L_2(c_b + c_1)}{A_2^2}\right] - \frac{L_c(c_t + c_2)}{A_1A_cE_c} - \frac{L_s(c_t + c_2)}{A_1^2E_s}\right\}$$

TABLE 1

Collar Area = .02 Sq. Inch
Collar Wall Thickness = .014 Inch
$c_2$ = .030 $c_t$ = .373 $c_b$ = .910 $10^{-6}$ Inch/Pound

| Length Inch | Sensitivity KHZ/pound | SEN1 | SEN2 | SEN3 | $c_1$ $10^{-6}$ Inch/Pound |
|---|---|---|---|---|---|
| 0.00 | −9.80 | −9.354 | −.628 | .177 | .236 |
| .02 | −9.00 | −8.893 | −.633 | .530 | .275 |
| .04 | −8.23 | −8.454 | −.638 | .867 | .314 |
| .06 | −7.49 | −8.035 | −.643 | 1.188 | .353 |
| .08 | −6.79 | −7.636 | −.648 | 1.494 | .392 |
| .10 | −6.12 | −7.255 | −.652 | 1.786 | .431 |
| .12 | −5.48 | −6.890 | −.657 | 2.065 | .470 |
| .14 | −4.87 | −6.541 | −.661 | 2.333 | .509 |
| .16 | −4.28 | −6.206 | −.665 | 2.589 | .548 |
| .18 | −3.72 | −5.886 | −.668 | 2.835 | .587 |
| .20 | −3.18 | −5.578 | −.672 | 3.071 | .627 |
| .22 | −2.66 | −5.283 | −.676 | 3.297 | .666 |
| .24 | −2.16 | −4.998 | −.679 | 3.515 | .705 |
| .26 | −1.68 | −4.725 | −.682 | 3.724 | .744 |
| .28 | −1.22 | −4.462 | −.685 | 3.926 | .783 |
| .30 | −.78 | −4.209 | −.688 | 4.120 | .822 |
| .32 | −.35 | −3.964 | −.691 | 4.308 | .861 |
| .34 | .07 | −3.728 | −.694 | 4.488 | .900 |
| .36 | .47 | −3.501 | −.697 | 4.663 | .939 |
| .38 | .85 | −3.281 | −.699 | 4.831 | .978 |
| .40 | 1.22 | −3.069 | −.702 | 4.994 | 1.017 |
| .42 | 1.58 | −2.863 | −.704 | 5.151 | 1.056 |
| .44 | 1.93 | −2.665 | −.706 | 5.304 | 1.096 |
| .46 | 2.27 | −2.472 | −.709 | 5.451 | 1.135 |
| .48 | 2.60 | −2.286 | −.711 | 5.594 | 1.174 |

Table I lists the total sensitivity (second column) as well as its components arising from the magnetic part of the center post 42 (SEN 1), the outer filter housing 12 (SEN 2) and the combined effect of cylindrical member 26 and RF structure 30 (SEN 3) as a function of the length of cylindrical member 26 for a given area (0.02 sq. in. cylindrical) and wall thickness (0.014 inches) of member 26. The computation is based on Equations (11) and (12) and assumes the numerical values listed in Equations (8) and (10). It is further assumed that all elastic moduli are equal and are given by $E = 22.5 \times 10^6$ psi.

The table shows that by increasing the length $L_c$ of cylindrical member 26, SEN 1 becomes less negative and SEN 3 more positive until cancellation occurs at a cylindrical member length $L_c$ of approximately 0.34". This is more than the total length of the upper portion 42a (FIG. 2) of center post 42 (0.315"), but less than the combined length of the upper portion 42 (FIG. 2) of center post 42 and the pole cap (0.415"). The wall thickness of collar 26 corresponding to $A_c$=0.02 sq. inch is 0.014", which may be too small in some applications. Therefore, in order to obtain the same beneficial effect from a thicker collar, the collar material should have a proportionately lower elastic modulus than assumed in arriving at the values listed in Table I.

Figure 5:
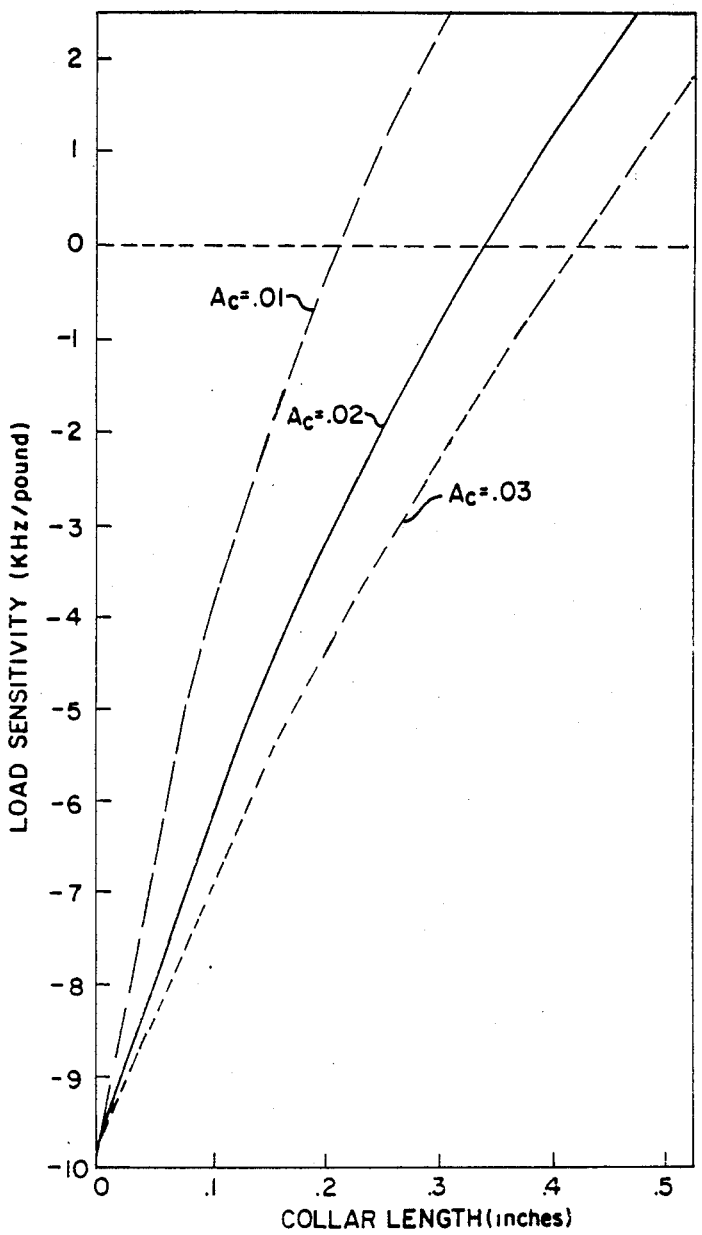
FIG. 5 is a graph of load sensitivity as a function of cylindrical member length for cylindrical members of different cross-sectional areas in accordance with the present invention.

FIG. 5 shows a graph of the load sensitivity as a function of collar length for different collar areas calculated from Equations (8) and (9).

Figure 6:
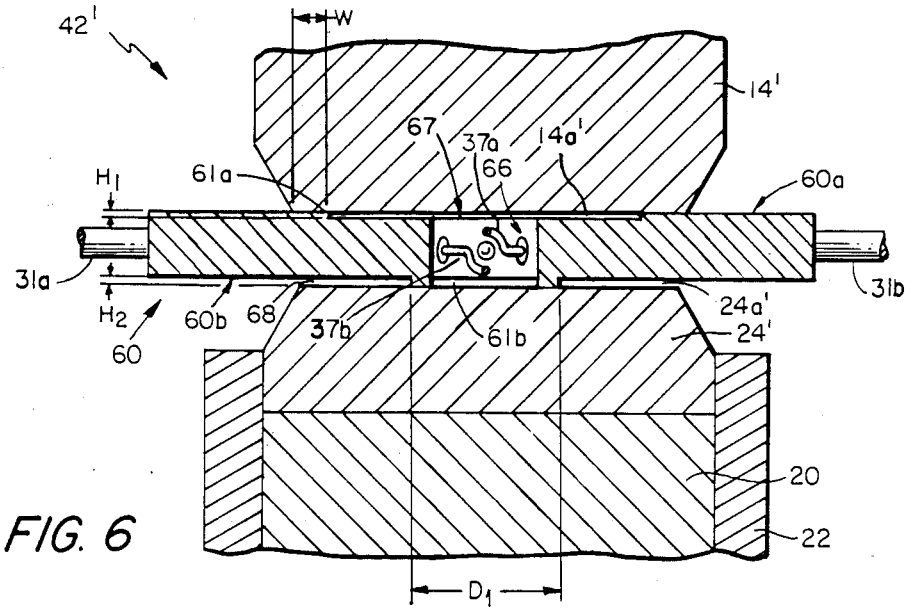
FIG. 6 is a cross-sectional enlarged view of a portion of a magnetically-tuned resonant circuit including an RF structure having a relatively high elastic compliance in accordance with an alternate embodiment of the present invention.

Referring now to FIG. 6, a portion of an alternate embodiment of the magnetically-tuned resonant circuit 10' is shown to include an RF structure 60 having a void 66 and similar to RF structure 30 except said RF structure 60 has a relatively high compliance and is disposed between surface portions 14a' and 24a' of pole pieces 14' and 24'. The RF structure 60 also includes coaxial transmission lines 31a, 31b and coupling loops 37a, 37b as described in conjunction with FIGS. 1-3. Pole piece 14' and pole piece 24' here are tapered, as shown. RF structure 60 has a raised peripheral edge portion 61a on here the upper surface portion 60a of the RF structure 60 and a raised central inner portion 61b on here the lower surface portion 60b of RF structure 60. By properly selecting the width W and height $H_1$ of the raised peripheral edge portion 61a and by properly selecting the diameter $D_1$ and height $H_2$ of the raised central inner portion 61b, an RF structure 60 having a controlled, relatively high compliance is provided. With this arrangement, the raised peripheral edge portion 61a on the upper facial portion 60a of the RF structure 60 provides a gap 67 between pole piece 14' and RF structure 60 in the area adjacent the void 66. Similarly, raised central inner portion 61b provides a gap 68 between outer peripheral portions of the RF structure 60 and the lower pole piece 24'. The upper gap 67 and lower gap 68 provide the RF structure 60 with a spring-like characteristic allowing the RF structure 60 to flex and bend in accordance with applied external forces. With such a relatively compliant RF structure 60, the sensitivity of the permeability of a central post 42' (a portion of which is shown in FIG. 6) and RF structure 60 caused by changes in the mechanical stresses applied to the filter are reduced. Therefore, the negative frequency shift resulting from reduction in permeability of the central post is likewise reduced. Further, the upper gap 67 provides a positive shift in resonant frequency as compressive force is applied to decrease the size of gap 67 and hence compensates for the remaining negative shift in resonant frequency due to decreasing permeability of the central post 42.

An analysis of the load sensitivity provided by use of an RF structure having a relatively high elastic compliance, as described in conjunction with FIG. 6 may be similarly provided. Calculations can show that for an RF structure 60 (FIG. 6) incorporated into a housing such as shown in FIG. 1 (without the load carrying cylindrical member 26), the load sensitivity (for a CAF, $F>F_c$) becomes zero when the compliance of the RF structure is approximately $1.3\times10^{-6}$ inch/pound (i.e., approximately 60 times the compliance of a solid metal block).

Figure 7:
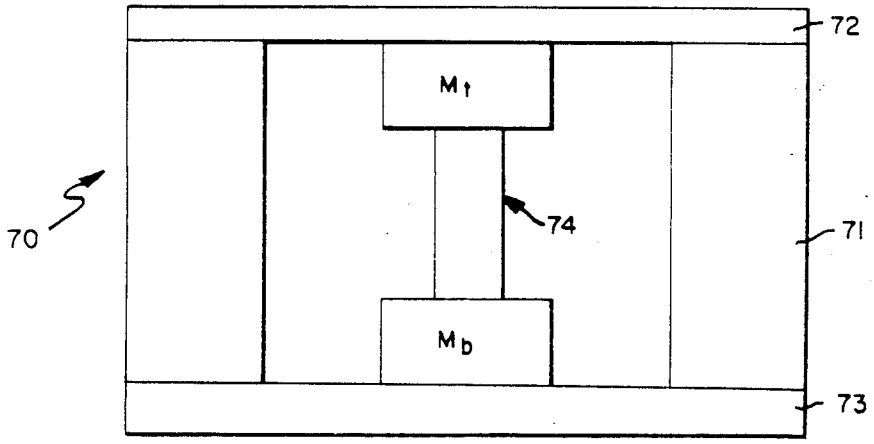
FIG. 7 is a model of an RF housing useful in describing an important relationship in accordance with a further alternate embodiment of the present invention.

A fourth technique of reducing the vibration sensitivity of magnetically-tuned resonant circuits can be understood in conjunction with a simplified model of a typical filter housing as shown in FIG. 7. In this model of the filter housing 70, the peripheral vertical portions 71 of the housing 70 are assumed to be perfectly rigid, and the central post portion 74, top plate 72 and bottom plate 73 are assumed to have a predetermined elastic compliance. It is further assumed that the inertia effects of movement of the filter housing can be approximated by effective masses $M_t$ and $M_b$ located, respectively, at the centers of the top plate 72 and bottom plate 73, as shown.

In the following only vertical vibrations of masses $M_t$ and $M_b$ are considered. Let $z_h$, $z_t$ and $z_b$ be the vertical displacements of the housing, the top (represented by the mass $M_t$) and the bottom (represented by the mass $M_b$) from their respective rest positions. Further, let $c_t$, $c_b$ and $c_l$ be the compliances of top, bottom and center post, respectively. The equations of motion for the two masses can then be written as:

$$M_t z_t = \frac{1}{c_t}(z_h - z_t) + \frac{1}{c_1}(z_b - z_t) \tag{13}$$

$$M_b z_b = \frac{1}{c_b}(z_h - z_b) + \frac{1}{c_1}(z_t - z_b)$$

where the dot denotes a time derivative.

The housing displacement $z_h$ can be an arbitrary function of time. Assuming that $z_h$ varies periodically at frequency $\omega$, i.e., $$z_h = z_{ho}\cos\omega t \tag{14}$$

one obtains as the solution of Equation (13)

$$z_t = z_{to}\cos\omega t$$

$$z_b = z_{bo}\cos\omega t \tag{15}$$

where $$z_{to} = z_{ho}\left[\frac{1}{c_t}\left(\frac{1}{c_b} + \frac{1}{c_1} - M_b\omega^2\right) + \frac{1}{c_b c_1}\right]/D$$

$$z_{bo} = z_{ho}\left[\frac{1}{c_b}\left(\frac{1}{c_t} + \frac{1}{c_1} - M_t\omega^2\right) + \frac{1}{c_t c_1}\right]/D$$

and where D=

$$D = \left(\frac{1}{c_t} + \frac{1}{c_1} - M_t\omega^2\right)\left(\frac{1}{c_b} + \frac{1}{c_1} - M_b\omega^2\right) - \frac{1}{(c_1)^2} \tag{16}$$

The periodic stress $\delta\sigma$ induced in a center post of uniform cross-sectional area $A_1$ is $$\delta\sigma = \delta\sigma_o\cos\omega t$$

where $$\delta\sigma_o = \frac{z_{bo} - z_{to}}{A_1 c_1} = \frac{\left(\frac{M_t}{c_b} - \frac{M_b}{c_t}\right)\omega^2 \cdot z_{ho}}{A_1 c_1 D} \tag{17}$$

In the present case the frequencies of interest are considerably smaller than the resonant frequencies of the filter housing. Under these conditions, the terms proportional to $\omega^2$ in coefficient D can be neglected and one obtains from Equations (16), (17)

$$\delta\sigma_o = \frac{(c_t M_t - c_b M_b)\omega^2 \cdot z_{ho}}{A_1(c_t + c_b + c_1)} \tag{18}$$

The dynamic frequency shift $\delta f_o$ produced by the vibration of the filter housing expressed as a fraction of the unperturbed resonant frequency $f_o$ is thus given by:

$$\left.\frac{\delta f_o}{f_o}\right|_{dyn} = -\frac{L_1\, 3\lambda_s}{L_m\, 4\pi M_s^2}\cdot\delta\sigma_o \tag{19}$$

$$= -\frac{L_1\, 3\lambda_s}{L_m\, 4\pi M_s^2}\cdot\frac{(c_t M_t - c_b M_b)\omega^2\cdot z_{ho}}{A_1(c_t + c_b + c_1)}$$

Here it is assumed that there is no air gap in the magnetic circuit, and that no load-bearing collar is used. The very small effect due to the compliance of the RF structure is neglected.

Equation (19) shows that the dynamic frequency shift ($\delta f_o/f_o$) will be substantially zero if $c_t M_t = c_b M_b$. The dynamic frequency shift will be substantially equal to zero if the housing is mechanically symmetric, that is, if the product of compliance and effective mass of the top plate of the housing equals the product of compliance and effective mass of the bottom plate of the housing.

Having described preferred embodiments of this invention, it will now be apparent to one of skill in the art that other embodiments incorporating its concept may be used. Further, combinations of these embodiments may also be used together. It is felt, therefore, that this invention should not be limited to the disclosed embodiment, but rather should be limited only by the spirit and scope of the appended claims.

What is claimed is:

1. A magnetically tuned resonant circuit comprising:
means for producing magnetic flux;
a body member having a void and a first pair of opposing surfaces, said body member having a gyromagnetic member disposed in said void;
means, having a second pair of opposing surfaces, for directing said magnetic flux through said gyromagnetic member, with the body member being disposed between the second pair of opposing surfaces of said directing means; and
means for spacing at least a portion of at least a first one of said first pair of surfaces of said body member from the corresponding one of said second pair of surfaces of said directing means in a region of said body member adjacent the void in said body member to reduce induced stresses in portions of the flux directing means adjacent to the body member.

2. The magnetically tuned resonant circuit of claim 1 wherein the means for spacing further comprises:
means disposed over peripheral portions of a first one of the first pair of opposing surfaces of the body member for spacing an inner portion of said first surface of the body member from an inner portion of a corresponding first one of the second pair of surfaces of the directing means; and
means disposed over an inner portion of the second one of the pair of first surfaces of the body member for spacing outer peripheral portions of said body member from corresponding outer portions of the second one of the second pair of surfaces of the directing means.

3. The magnetically tuned resonant circuit of claim 1 wherein said spacing means comprises a cylindrical non-magnetic member.

4. The magnetically tuned resonant circuit of claim 3 wherein said non-magnetic member is also non-conductive.

5. The magnetically tuned resonant circuit of claim 3 wherein said cylindrical non-magnetic member comprises means for preventing a closed path for induced eddy current flow through said member.

6. The circuit of claim 1 wherein the spacing means comprises a non-magnetic cylindrical member having a predetermined height selected to provide a gap having a predetermined length between the first one of said first pair of surfaces of the body member and the corresponding one of the second pair of surfaces of the directing means.

7. The circuit of claim 6 wherein the cylindrical member is provided to reduce elastic stress from portions of the directing means adjacent to and part of the corresponding second surface of the directing means, to increase the mechanical compliance between the body member and the remaining one of the second pair of surfaces of the directing means, and wherein the length of the gap is selected to change in response to applied mechanical stress, to provide in combination, the magnetically tuned resonant circuit having a resonant frequency which is substantially invariant with changes in mechanical stress.

8. A magnetically tuned resonant circuit comprising:
(a) means, comprising a composite member, for providing a closed magnetic flux path, said composite member having a predetermined mechanical compliance, said composite member comprising:
(i) means for producing magnetic flux;
(ii) means, including a gyromagnetic body and a magnetically inert member having a void, said gyromagnetic body being disposed in the void provided in said magnetically inert member for producing in combination with the magnetic flux a resonant circuit; and
(b) means for increasing the predetermined mechanical compliance characteristic of the composite member.

9. The circuit of claim 8 wherein the means for increasing the mechanical compliance comprises:
means disposed over peripheral portions of a first surface of the magnetically inert member for spacing an inner portion of the first surface of the magnetically inert member from a corresponding inner portion of the flux return loop; and
means, disposed over central inner portions of the second opposite surface of the magnetically inert member for spacing outer peripheral portions of the second surface of the magnetically inert member from a corresponding outer portion of the flux return loop.

10. The circuit of claim 8 wherein the means for increasing the mechanical compliance comprises a spacer member disposed between the magnetically inert member and flux return means.

11. The magnetically tuned resonant circuit of claim 10 wherein the spacer member is a cylindrcial member disposed in a region adjacent the gyromagnetic body and between the inert member and flux return means to provide a gap having a predetermined length between said flux return means and inert member.

12. The circuit of claim 11 wherein the cylindrical member is provided to reduce elastic stress from portions of the flux return means adjacent to said cylindrical member and magnetically inert body member, to increase the mechanical compliance between the inert member and remaining non-adjacent portion of the flux return means, and wherein the length of the cap is selected and changes in response to applied external mechanical stress, to provide in combination the magnetically tuned resonant circuit having a resonant frequency which is substantially invariant with changes in mechanical stress.

13. The magnetically tuned resonant circuit of claim 8 wherein the means for increasing the mechanical compliance comprises a spacer member disposed between a first one of a first pair of opposing surfaces of the magnetically inert member and a corresponding one of a second pair of surfaces of the flux producing means.

14. The magnetically tuned resonant circuit of claim 13 wherein the spacer member comprises a cylindrical member comprising a non-magnetic material.

15. The magnetically tuned resonant circuit of claim 14 wherein said non-magnetic spacer member further comprises a member having a non-closed path for induced electromagnetic energy eddy current flow in response to a changing R.F. magnetic field associated with coupling of resonant frequency energy through the magnetically tuned circuit.

16. A magnetically tuned resonant circuit having a resonant frequency $f_o=\gamma H_{DC}$, where $\gamma$ is a quantity referred to as the gyromagnetic ratio, and $H_{DC}$ is the magnitude of the magnetic flux passing through the resonant circuit, the resonant frequency of said magnetically tuned resonant circuit having a first predetermined variation as a function of mechanical stress and wherein said magnetically tuned resonant circuit comprises:

(a) a housing comprised of a magnetically permeable material and having first and second portions spaced by an outer wall portion, said first and second portions having respective first and second opposing spaced surfaces;

(b) a composite member disposed between said first and second opposing spaced surfaces, the composite member comprising:

(i) central portions of said first and second opposing spaced surfaces of said housing;

(ii) means for producing magnetic flux density $H_{DC}$ disposed over the first opposing spaced surface of said housing;

(iii) means, including a gyromagnetic body an a magnetically inert member having a void, said gyromagnetic body being disposed within the void provided in said magnetically inert member, for producing in combination with the magnetic flux density $H_{DC}$, the resonant circuit, said means being disposed between said magnetic flux producing means, and the second opposing spaced surface of said housing;

(c) means, disposed adjacent the composite member and isolated from the outer wall portion of said housing, for reducing by a predetermined amount, the change in resonant frequency of the resonant circuit as a function of external mechanical stress.

17. The magnetically tuned resonant circuit of claim 16 wherein the housing material has a saturation magnetostrictive characteristic less than or equal to $3.2\times10^{-6}$ to further reduce changes in resonant frequency as a function of mechanical stress.

18. The magnetically tuned resonant circuit of claim 16 wherein mechanical compliances of the first and second opposing surfaces of the housing and effective masses associated with said first and second opposing surfaces of the housing are selected such that the product of the compliance of the first surface of the housing and the mass associated with the first surface of the housing is substantially equal to the product of the compliance of the second surface of the housing and the effective mass associated with said second surface of the housing to further reduce changes in resonant frequency as a function of external mechanical stress.

19. The magnetically tuned resonant circuit as recited in claim 16 wherein said means for reducing changes in resonant frequency of the resonant circuit as a function of mechanical stress includes means for increasing the mechanical compliance of the composite member.

20. The magnetically tuned resonant circuit of claim 19 wherein the means for increasing the mechanical compliance comprises:

means, disposed over a peripheral outer portion of a first surface of the magnetically inert member, for spacing an inner portion of said first surface of the magnetically inert member from a corresponding inner portion of a first one of the magnetic flux producing means and the second opposing spaced surface of the housing; and means disposed over a central inner portion of a second, opposite surface of the magnetically inert member for spacing outer peripheral portions of the second surface of the magnetically inert member from corresponding outer portions of a second one of the magnetic flux producing means and the second opposing spaced surface of the housing

21. The magnetically tuned resonant circuit as recited in claim 19 wherein the means for increasing the mechanical compliance of the composite member comprises a spacer member disposed between the magnetically inert member and a first one of said magnetic flux producing means and the second opposing spaced surface of the housing.

22. The magnetically tuned resonant circuit as recited in claim 21 wherein the spacer member is a cylindrical member comprised of a non-magnetic material.

23. The magnetically tuned resonant circuit as recited in claim 22 wherein the non-magnetic material is also non-conductive.

24. A magnetically tuned resonant circuit having a resonant frequency $f_o$ in accordance with $f_o=\gamma H_{DC}$, where $\gamma$ is a quantity referred to as the gyromagnetic ratio, and $H_{DC}$ is the magnitude of the magnetic flux passing through the resonant circuit, said magnetically tuned resonant circuit comprising:

(a) a housing having first and second opposing surfaces and having an inner void between said surfaces, said housing being comprised of a magnetically permeable material having a saturation magnetostriction characteristic less than or equal to about $3.2\times10^{-6}$ to reduce changes in resonant frequency as a function of external mechanical stress;

(b) a composite member disposed within the void in said housing, the composite member comprising:

(i) central portions of said first and second opposing surfaces of said housing;

(ii) means for producing magnetic flux density $H_{DC}$ disposed over a first one of said opposing central portions of said housing; and (iii) means including a gyromagnetic body and a magnetically inert member having a void, said gyromagnetic body being disposed within the void provided in said magnetically inert member for producing in combination with the magnetic flux density $H_{DC}$, the resonant circuit, said means being disposed between siad magnetic flux producing means, and a second one of said opposing central portions of said housing.

25. A magnetically tuned resonant circuit having a resonant frequency $f_o$ in accordance with $f_o=\gamma H_{DC}$, where $\gamma$ is a quantity referred to as the gyromagnetic ratio, and $H_{DC}$ is the magnitude of the magnetic flux passing through the resonant circuit, wherein said magnetically tuned resonant circuit comprsies:

(a) a housing having first and second opposing surfaces and having an inner void between said surfaces, said housing being comprised of a magnetically permeable material having a predetermined saturation magneto-striction characteristic;

(b) a composite member disposed within the void in said housing, the composite member comprising:

(i) central portions of said first and second opposing surfaces of said housing;

(ii) means for producing magnetic flux density $H_{DC}$ disposed over a first one of said opposing central portions of said housing;

(iii) means including a gyromagnetic body and a magnetically inert member having a void, said gyromagnetic body being disposed within the void provided in said magnetically inert member for producing in combination with the magnetic flux density $H_{DC}$, the resonant circuit, said means being disposed between said magnetic flux produced means, and a second one of said opposing central portions of said housing; and wherein mechancial compliances of the first and second opposing surfaces of the housing and effective masses associated with said first and second opposing surfaces of the housing are selected such that the product of the compliance of the first surface of the housing and the mass associated with the first surface of the housing is substantially equal to the product of the compliance of the second surface of the housing and the effective mass associated with said second surface of the housing to reduce changes in resonant frequency as a function of external mechanical stress.

* * * * *